US007375698B2

(12) United States Patent
Wolfenden et al.

(10) Patent No.: US 7,375,698 B2
(45) Date of Patent: May 20, 2008

(54) HYDROPHOBIC FEED WINDOW

(75) Inventors: Neil Wolfenden, Berkshire (GB); Rosalind Elizabeth Batson, St. Paul, MN (US)

(73) Assignee: Andrew Corporation, Westchester, IL (US)

( * ) Notice: Subject to any disclaimer, the term of this patent is extended or adjusted under 35 U.S.C. 154(b) by 103 days.

(21) Appl. No.: 11/292,912

(22) Filed: Dec. 2, 2005

(65) Prior Publication Data

US 2007/0126652 A1 Jun. 7, 2007

(51) Int. Cl.
*H01Q 13/00* (2006.01)

(52) U.S. Cl. ..... 343/786; 343/779; 343/772

(58) Field of Classification Search ..... 343/786
See application file for complete search history.

(56) References Cited

U.S. PATENT DOCUMENTS 4,387,176 A * 6/1983 Frye ..... 524/268
4,536,765 A 8/1985 Kaminski
4,783,666 A 11/1988 Ast et al.
5,023,300 A 6/1991 Huff et al.
5,153,382 A * 10/1992 Gross et al. ..... 174/110 SR
5,298,561 A 3/1994 Cecchin et al.
5,429,073 A * 7/1995 Ballard ..... 119/171
5,815,125 A 9/1998 Kelly et al.
5,897,919 A * 4/1999 Merrill et al. ..... 427/389.7
5,933,560 A 8/1999 Ishiharada et al.
6,072,012 A 6/2000 Juen et al.
6,072,440 A 6/2000 Bowman
6,087,015 A 7/2000 Cretekos et al.
6,153,680 A 11/2000 Shah et al.
6,191,753 B1 2/2001 Ellis et al.
6,368,700 B1 4/2002 Venkataswamy et al.
2002/0034988 A1* 3/2002 Binette et al. ..... 473/373
2004/0014865 A1* 1/2004 Keller et al. ..... 524/442
2005/0225495 A1* 10/2005 King ..... 343/840
2005/0282953 A1* 12/2005 Simendinger et al. ..... 524/502

OTHER PUBLICATIONS

Dow Corning Product Information, MB50-001 Masterbatch—Ultra-High Molecular Weight Siloxane Polymer, Dispersed in Polypropylene Homopolymer (Jan. 15, 2001).
Multibase (A Dow Corning Company)—Siloxane Additives for Molding Polypropylene and Thermoplastic Olefins (2002).
Dow Corning—Siloxane Materials with High Reliability for Use as Polymer Waveguides (2003).

* cited by examiner

*Primary Examiner*—Trinh Vo Dinh
(74) *Attorney, Agent, or Firm*—Welsh & Katz, Ltd.

(57) ABSTRACT

A feed window for a low noise block converter feedhorn incorporated into a microwave-range antenna assembly is formed from a thermoplastic polymer composition containing a hydroscopic-effective amount of a high molecular weight siloxane.

18 Claims, 1 Drawing Sheet

HYDROPHOBIC FEED WINDOW

BACKGROUND OF THE INVENTION

This invention relates to feed windows assembled to cover electronic components in a low noise block converter with integrated feed (LNBF) such as used in direct satellite broadcasting receivers and particularly relates to polyolefin based compositions suitable for such feed windows.

A low noise block converter (LNB) is used in communication satellite reception equipment and typically is mounted on or in a satellite antenna dish. In typical practice, communication satellites transmit signals using microwave range radio frequencies in the range of 10 to 40 gigahertz (GHz). Particularly useful for this use is the $K_u$ band which ranges from about 12 to 18 GHz and more particularly the $K_a$ band which ranges from about 18 to 40 GHz. In order to receive and use radiofrequency (rf) signals at an earth-based location, typically the microwave signals received from the communications satellite must be converted to lower or intermediate frequency signals at the point of reception. The lower frequency signals (typically in the range of 900 to 1500 MHz) then may be directed more easily and economically through cables to other locations. A low noise block converter is used to convert microwave range rf signals to intermediate rf signals. Typically, direct broadcast satellite (DBS) dishes use an LNBF which integrates the feedhorn of an antenna with an LNB. A typical DBS receiver is a parabolic dish with a feedhorn placed at the focal point of the dish.

In order to receive or transmit microwave rf signals from a DBS, an antenna typically is located outside of a building or structure and in line-of-sight to the satellite. Thus, the antenna with an LNB is subject to outside weather conditions including precipitation such as rain or snow. However, water is a very efficient absorber of microwave rf signals, and in order to minimize rf signal attenuation, water adhering on the antenna and especially on an LNB should be avoided. Thus, in usual practice the LNBF is covered with a feed window which is both hydrophobic and is substantially invisible to microwave signals. An example of an LNBF cover is described in U.S. Pat. No. 6,072,440.

Use of HDPE and ABS thermoplastic polymers for antenna cover assemblies have been described in U.S. Pat. No. 6,191,753 as weather resistant. Laminates have been used as described in U.S. Pat. No. 5,815,125 as covers using a porous polytetrafluoroethylene outer layer laminated to a thermoplastic substrate, although usually, laminate materials are costly to manufacture. Alternatives to laminates include external non-stick or hydrophobic coatings such as described in U.S. Pat. No. 4,536,765. However, external coatings may wear through weathering or abrasion and provide a diminished hydrophobic surface over time. Complex protective shields for high performance antennal arrays have been described in U.S. Pat. No. 4,783,666 as a sandwich formed between fiberglass layers and a central foam core on which a polytetrafluoroethylene layer is applied coated with fumed silica ($SiO_2$). The polytetrafluoroethylene-fumed $SiO_2$ was said to minimize effects of rain on antenna performance.

A feed window or LNBF cover may be formed from a polyolefin thermoplastic such as a propylene polymer. Although polypropylene has some hydrophobic properties, the hydrophobic character of polypropylene alone typically is insufficient for current applications.

We have discovered that a feed window formed from a polyolefin composition containing a specified amount of a high molecular weight siloxane, especially a polydialkylsiloxane, shows a substantial increase of hydrophobic character over the polyolefin alone. Such a uniform composition is easily mouldable, does not degrade through weathering and abrasion, and is economical.

SUMMARY OF THE INVENTION

A feed window for a low noise block converter feedhorn incorporated into a microwave-range antenna assembly is formed from a thermoplastic polymer composition containing a hydroscopic-effective amount of a high molecular weight siloxane.

DESCRIPTION OF THE INVENTION

Figure 1:
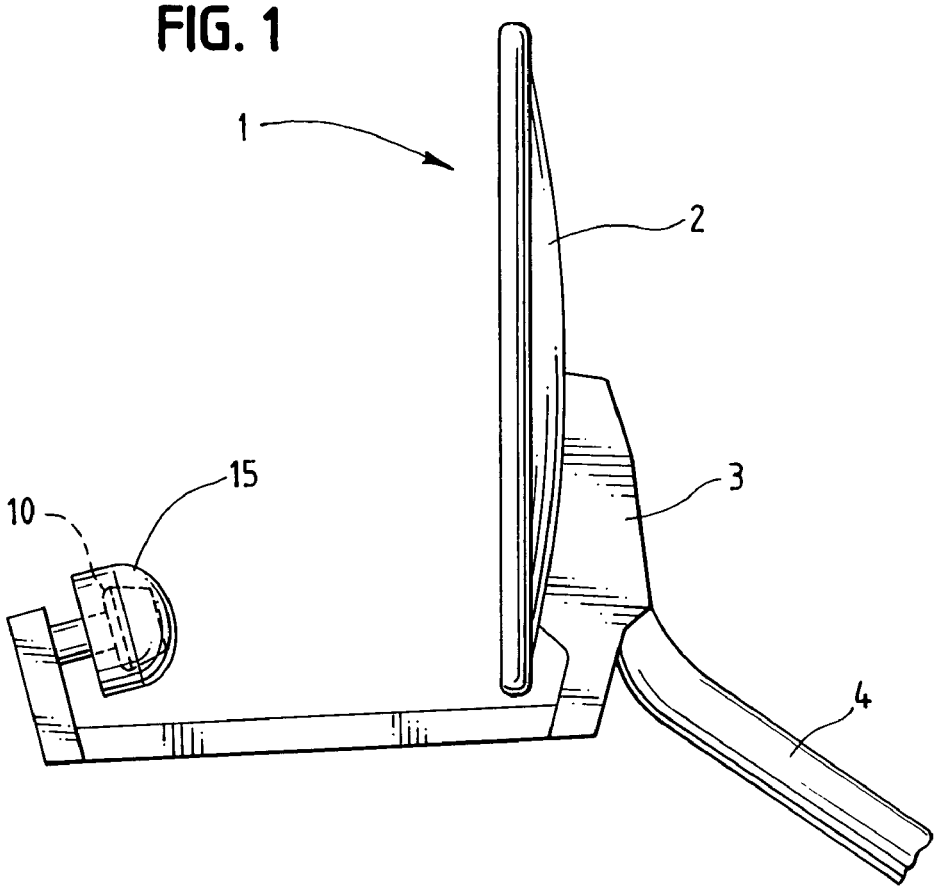
FIG. 1 illustrates a typical direct broadcast antenna assembly comprising an LNBF with a feed window mounted within a parabolic dish.

Feed windows of this invention are formed from thermoplastic polymer materials into which is incorporated a hydrophobic-effective amount of a suitable siloxane. These feed windows typically are used to cover low-noise block converters incorporated within direct broadcast satellite receivers, and particularly covers the feedhorn portion of the LNB through which microwave rf signals must pass to electronic components which convert such microwave rf signals to lower frequency rf signals. These covers may be in the shape of a dome, but also may be formed into any shape suitable to provide weather protection to an LNB. Although such feed windows are used as part of a microwave receiver, similar feed windows may be used to cover electronic components in a microwave transmitter such as may be used in a two-way DBS system.

A feed window provides protection from weather and other possible intrusions to the LNB electronic components in a DBS receiver. In order to function as a feed window, microwave range rf signals must be able to pass through such a feed window without significant loss of signal. Thus, the material from which the feed window is formed should be substantially invisible to the microwave rf spectrum. Thermoplastic polymers such as polyolefins are suitable for this purpose. Further, in actual use, a feed window advantageously is positioned over the LNB component such that weather elements, such as rain and snow, drain off the structure by gravity. However, water applied to a surface will form droplets on that surface, which will remain even if the surface is tilted. A commonly-observed representation of this effect is rain falling on a glass windshield or windscreen of an automobile. Water droplets will form and remain on the glass, even though most water drains away. As indicated above, water collected on a feed window will cause a significant rf signal loss. Thus, a feed window that sheds water through increased hydrophobic characteristics is desirable.

Suitable thermoplastic polymeric materials used in this invention include polymers and copolymers of ethylene and alpha-olefins, typically $C_3$ to $C_8$ alpha-olefins, and preferably propylene. Suitable polymers are mouldable and capable of being formed into shapes with sufficient strength and stiffness to act as a feed window. Propylene polymers are the preferable thermoplastic resin used in this invention. Suitable propylene polymers include propylene homopolymer, and random and block copolymers of propylene with ethylene or a $C_4$-$C_8$ alpha-olefin. Preferable thermoplastics are a propylene polymer such as a homopolymer of propylene, a random copolymer of propylene containing up to 5 wt. % ethylene, and a "block" copolymer of propylene with up to 20 wt. % ethylene. Block copolymers usually are intimate mixtures of a crystalline propylene homopolymer combined with an elastomeric or rubber-like propylene/ethylene random copolymer and typically are produced in a multi-reactor system or as physical blends, as known in the art.

Useful thermoplastic polyolefins are normally solid and typically have a melt index ranging from 0.1 to 60 g/10 min (ASTM 1238, 230° C., 2.16 kg). Suitable polyolefins have a typical melt index ranging from 2, preferably at least 5, and may range up to 40. Preferable polyolefins have been found to have melt indices of 10 to 30 g/10 min.

Polysiloxanes (also referred to as siloxanes) useful in this invention are polymers containing units of $R_2$—SiO— wherein R is alkyl or aryl, may be the same or different, and may contain 1 to 8 carbon atoms. Suitable siloxanes typically are lower alkyls containing 1 to 6, (preferably 1 to 2) carbon atoms. Methyl is the preferred R-group. Mixtures of siloxanes may be used and may be copolymers containing different monomeric silicon-containing units. The preferred siloxane used in this invention is polydimethylsiloxane.

Polydialkylsiloxanes used in this invention typically are known as a high or ultra-high molecular weight polydialkylsiloxanes, typically having a number average molecular weight above 60,000, usually above 100,000, and preferably above 200,000. Suitable ultra-high molecular weight polydialkylsiloxanes may have number average molecular weights above 250,000 and may range up to 1,000,000. Typical viscosities of suitable ultra-high molecular weight polydialkylsiloxanes exceed 100,000 $cm^2$/sec (10,000,000 centistokes) and typically may range from 150,000 to 200,000 $cm^2$/sec.

Polyolefin compositions used in this invention also may contain suitable additives (typically up to about 2 wt. %), such as stabilizers, anti-oxidants, uv-blockers, colorants, and the like, as known in the art.

Mixtures of suitable siloxanes combined as masterbatches with polyolefins or other compatible polymer resin are useful in forming the compositions used in this invention. For example, suitable siloxanes may be combined with a polypropylene or polyethylene as a masterbatch, which then is added to and blended with a polymer used to form the LNBF's of this invention. Suitable masterbatches are sold under the tradename MB50™ by Dow Corning. Specifically useful is MB50-001™, which is a 50:50 mixture of an ultra-high molecular weight polydimethylsiloxane and a polypropylene homopolymer having a melt index of 12 g/10 min.

For feed windows formed from a propylene polymer, preferably the siloxane is added as a masterbatch in polypropylene.

Typically, a suitable siloxane incorporated in a masterbatch composition is blended with a polymer resin (such as a propylene polymer) in a mixer such as an extruder before being formed (such as by injection moulding) into the shape useful as a LNBF window of this invention.

The hydrophobic-effective amount of siloxane used as an internal hydrophobic agent typically is above about 0.1 wt. % of the polymer composition. More typically, the siloxane is incorporated at a level at least 0.25 wt. %. Useful amounts of siloxane may range up to about 3 wt. % and typically are no more than about 2 wt. %. Good results have been found at a siloxane level of 0.4 wt. %. Surprisingly, it was found that increasing the amount of siloxane above a relatively low amount lowered the hydrophobic effect of the composition as part of a feed window. If a 50:50 masterbatch of siloxane and polymer resin is used, the amount (in weight percent) of masterbatch incorporated will be twice the above-stated amounts of siloxane alone.

By hydrophobic-effective amount, it is meant that a feed window formed from a polymer composition containing this amount of additive will show a lower signal loss due to water droplets applied to the feed window than a similar feed window formed from the same polymer composition without the additive.

FIG. 1 illustrates a typical direct broadcast satellite microwave range antenna assembly 1 comprising a parabolic antenna dish 2 connected by member 3 to a low noise block converter 10 mounted in front of the antenna dish at a location selected to receive microwave range rf signals. The low noise block converter is covered by feed window 15 (as shown in more detail in FIG. 2). The assembly suitably is mounted to a structure through member 4.

Our invention is illustrated, but not limited by, the following examples and comparative runs.

EXAMPLES

Figure 2:
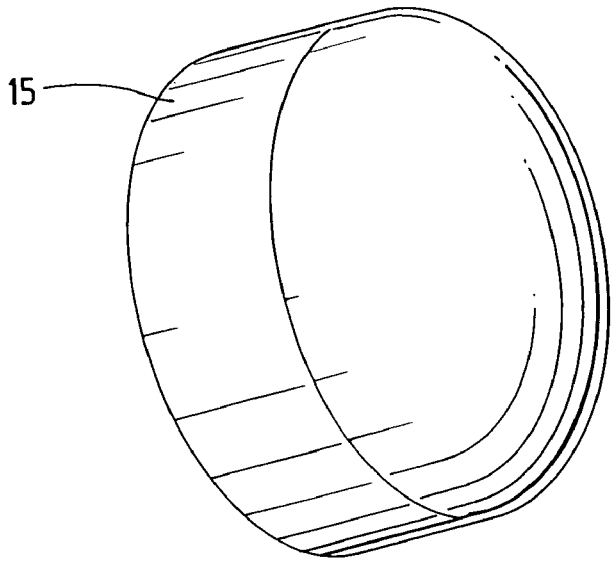
FIG. 2 illustrates a typical LNBF feed window.

Feed windows were formed in the shape of a dome (suitable for use in a Direct TV $K_a$/$K_u$ Feed Window) as illustrated in FIG. 2 or a flat shape (suitable for used as a US Dual Feed Window) using different formulations of polymer and treatments. These shapes were tested under various conditions to determine the relative suitability of such feed windows under weather and wear conditions.

The base polyolefin used in these tests was a high impact, high flowability propylene block copolymer identified as Samsung BJ730 having a melt index of 27 g/10 min., a flexural modulus (ASTM D790) of 1470 MPa, an Izod impact strength (ASTM D258) of 8 kg cm/cm at 23° C. and 4 kg cm/cm at −20° C., and a density (ASTM D1505) of 0.910 g/$cm^3$. This base resin was formulated with 0.8 wt. % light absorbers (0.4 wt. % Tinuvin 770DF™+0.4 wt. % Chimassorb 944LD™) from Ciba Specialty Chemicals.

Feed window structures moulded from such base polyolefin were coated with various materials including Flurothane MW™ (Valspar), Rainshield™ (Rainshield Marketing S/b), XLAN™ (Whitford Corporation), FAB Seal™, and common paint as listed in Table 1.

Feed windows of this invention were moulded from a mixture of the base polymer and a siloxane-containing masterbatch containing 50 wt. % ultra-high molecular weight polydimethylsiloxane and 50 wt. % polypropylene (MB50-001™) and 50 wt. % ultra-high molecular weight polydimethylsiloxane and 50 wt. % high density polyethylene (MB50-002™), both sold by Dow Corning, as shown in Table 2. The mixture of masterbatch and base resin were combined in an injection moulder.

In the tests, the set of feed windows were subjected to ten sprays from an atomiser spray nozzle. The spray nozzle was held around 6 inches (15 cm) away from the windows. Water was applied from a spray nozzle to each window simulating a fine mist and a heavy droplet condition. Care was taken to recreate the same condition for each of the windows tested.

Radiofrequency signal tests were carried out on a 760 meter test range at 18.3 GHz-18.8 GHz and 19.7 GHz-20.2 GHz. Signal loss results were reported in decibels (dB).

In addition, a second set of feed windows was subjected to a rub simulation test in which tape was placed onto the window for 14 hours and then removed and sprayed in a similar manner. Signal loss tests were performed on those samples. Deterioration of signal was apparent where the tape was successful in removing the coating from the window surface, and the majority of the rub samples did not do well in these tests. It should be noted from the rub control tests with no coating, tape residue may affect the signal loss results to a minor degree. However, in those tests on a coated substrate, typically there appears a larger degree of signal loss than is explainable by tape residue. Deterioration of signal was apparent where the tape was successful in removing the additive the window surface.

Table 1 presents signal loss results for various coated samples and Table 2 presents results for feed windows made from a composition incorporating a siloxane hydrophobic component.

The data show that feed windows formed from a polymer composition containing a suitable level of a polydialkylsiloxane (specifically an ultra-high molecular weight polydimethylsiloxane) creates a hydrophobic surface which effectively drains water from the feed window and reduces signal loss due to microwave absorption by water. These feed windows are not subject to wear to the extent seen in feed windows coated with a hydroscopic material.

TABLE 1

| | | Fine Misting | | Heavy Droplets | | Fine Misting Rub samples | | Heavy Droplets Rub samples | |
|---|---|---|---|---|---|---|---|---|---|
| Surface Treatment | Window Shape | 18.3-18.8 GHz | 19.7-20.2 GHz | 18.3-18.8 GHz | 19.7-20.2 GHz | 18.3-18.8 GHz | 19.7-20.2 GHz | 18.3-18.8 GHz | 19.7-20.2 GHz |
| None | Dome | 0.198 | 0.226 | 0.602 | 0.650 | 0.268 | 0.340 | 0.748 | 1.030 |
| None | Flat | 0.155 | 0.424 | 0.438 | 0.686 | 0.132 | 0.141 | 0.311 | 0.353 |
| Flurothane[1] MW | Dome | 0.056 | 0.141 | 0.340 | 0.523 | 0.297 | 0.500 | 0.862 | 1.248 |
| Flurothane[1] MW | Flat | 0.056 | 0.090 | 0.155 | 0.162 | 0.198 | 0.127 | 0.311 | 0.282 |
| Rainshield[2] | Dome | 0.085 | 0.155 | 0.367 | 0.636 | 0.170 | 0.297 | 0.904 | 1.243 |
| Rainshield[2] | Flat | 0.127 | 0.113 | 0.395 | 0.268 | 0.070 | 0.085 | 0.212 | 0.297 |
| XLAN[3] | Flat | 0.113 | 0.127 | 0.712 | 0.678 | | No window | | |
| FAB Seal[4] | Flat | 0.070 | 0.070 | 0.297 | 0.537 | 0.155 | 0.170 | 0.297 | 0.340 |
| OMS Superhydro[5] | Dome | 0.070 | 0.099 | 0.636 | 0.975 | 0.254 | 0.452 | 0.847 | 1.167 |
| OMS Superhydro[5] | Flat | 0.113 | 0.150 | 0.297 | 0.500 | 0.113 | 0.113 | 0.180 | 0.353 |
| Paint | Dome | 0.410 | 0.325 | 1.525 | 1.497 | 0.960 | 0.834 | 2.373 | 2.062 |
| Paint | Flat | 0.466 | 1.003 | 0.692 | 1.356 | [6] | [6] | [6] | [6] |

[1]Coated by brush
[2]Applied by spray can
[3]Coating without primer peeled with tape test
[4]Applied by spraying with an atomiser spray
[5]Applied by dip process
[6] Test not performed

TABLE 2

| Internal | | Fine Misting | | Heavy Droplets | | Fine Misting Rub samples | | Heavy Droplets Rub samples | |
|---|---|---|---|---|---|---|---|---|---|
| Hydrophobic Component | Window Shape | 18.3-18.8 GHz | 19.7-20.2 GHz | 18.3-18.8 GHz | 19.7-20.2 GHz | 18.3-18.8 GHz | 19.7-20.2 GHz | 18.3-18.8 GHz | 19.7-20.2 GHz |
| None | Dome | 0.198 | 0.226 | 0.602 | 0.650 | 0.268 | 0.340 | 0.748 | 1.030 |
| None | Flat | 0.155 | 0.424 | 0.438 | 0.686 | 0.132 | 0.141 | 0.311 | 0.353 |
| MB50-001-0.8 wt. % | Dome | 0.070 | 0.085 | 0.340 | 0.410 | 0.198 | 0.297 | 0.537 | 0.791 |
| MB50-001-3.2 wt. % | Dome | 0.191 | 0.325 | 0.410 | 0.720 | 0.155 | 0.297 | 0.360 | 0.720 |
| MB50-002-0.8 wt. % | Dome | 0.099 | 0.170 | 0.268 | 0.466 | 0.212 | 0.918 | 0.438 | 1.356 |
| MB50-002-3.2 wt. % | Dome | 0.113 | 0.212 | 0.268 | 0.486 | 0.184 | 0.254 | 0.650 | 0.932 |

What is claimed is:

1. A microwave-range antenna assembly comprising a low noise block converter feedhorn fixed within antenna dish covered by a feed window formed from a thermoplastic polymer containing a hydroscopic-effective amount of a high molecular weight polydialkylsiloxane.

2. An assembly of claim 1 in which the feed window is formed from a propylene polymer composition containing 0.1 to 3 wt. % of an ultra-high molecular weight siloxane having a viscosity of 100,000 to 200,000 $cm^2$/sec.

3. An assembly of claim 2 in which the propylene polymer composition contains 0.25 to 2 wt. % siloxane having a viscosity of 150,000 to 200,000 $cm^2$/sec.

4. An assembly of claim 3 in which the siloxane is added to the propylene polymer as a masterbatch of siloxane and a polyolefin.

5. A method to protect a low noise block converter feedhorn from weather comprising covering the feedhorn with a feed window formed from a thermoplastic polymer containing a hydroscopic-effective amount of a high molecular weight polydialkylsiloxane.

6. A method of claim 5 in which the feed window is formed from a propylene polymer composition containing 0.1 to 3 wt. % of an ultra-high molecular weight polydimethylsiloxane having a viscosity of 100,000 to 200,000 $cm^2$/sec.

7. A method of claim 6 in which the propylene polymer is a block copolymer of propylene and ethylene.

8. A method of claim 7 in which the propylene polymer composition contains 0.25 to 2 wt. % siloxane.

9. A feed window for a low noise block converter feedhorn incorporated into a microwave-range antenna assembly, said feed window formed from a thermoplastic polymer composition containing a hydroscopic-effective amount of an ultra-high molecular weight polydialkylsiloxane.

10. A feed window of claim 9 wherein the thermoplastic polymer is a polyolefin of monomer units containing 2 to 8 carbon atoms.

11. A feed window of claim 9 wherein the thermoplastic polymer is a propylene polymer.

12. A feed window of claim 11 wherein the propylene polymer contains up to 20 wt. % copolymerized ethylene monomer.

13. A feed window of claim 9 wherein the hydroscopic-effective amount of siloxane is between 0.1 and 3 wt. % of the polymer composition.

14. A feed window of claim 9 wherein the hydroscopic-effective amount of siloxane is between 0.25 and 2 wt. % of the polymer composition.

15. A feed window of claim 11 wherein siloxane is added to the propylene polymer as a masterbatch of siloxane and a polypropylene.

16. A feed window of claim 9 wherein the polydialkylsiloxane has a viscosity of 100,000 to 200,000 $cm^2$/sec.

17. A feed window of claim 9 formed from a propylene polymer composition containing an ultra-high molecular weight polydimethylsiloxane having a viscosity of 150,000 to 200,000 $cm^2$/sec in which the polydialkylsiloxane is incorporated into the propylene polymer composition as a 50:50 masterbatch of polydialkylsiloxane and polypropylene and wherein such masterbatch is incorporated at a level of 0.25 to 2 wt. % in the propylene polymer.

18. A feed window of claim 17 in which the propylene polymer is a block copolymer containing up to 20 wt. % ethylene.

* * * * *